United States Patent [19]

Ehrat

[11] 4,030,325

[45] June 21, 1977

[54] LOCK

[75] Inventor: Kurt Ehrat, Zurich, Switzerland

[73] Assignee: KESO AG, Richterswil, Switzerland

[22] Filed: Apr. 22, 1975

[21] Appl. No.: 570,422

[30] Foreign Application Priority Data

Apr. 25, 1974 Switzerland ..... 5802/74

[52] U.S. Cl. ..... 70/383

[51] Int. Cl.[2] ..... E05B 25/00

[58] Field of Search ..... 70/383, 382, 392

[56] References Cited

UNITED STATES PATENTS 3,774,424 11/1973 Ehrat ..... 70/383

*Primary Examiner*—Richard E. Moore

*Attorney, Agent, or Firm*—Hans Berman

[57] ABSTRACT

A mechanical lock comprises a cylindrical stator, a main rotor constituting the lock cylinder and being mounted for rotation in the stator and an auxiliary rotor mounted in the main rotor. A key carrying information can be inserted into the keyhole of the main rotor and turned to rotate the same between angular positions corresponding to an open and closed lock position through an intermediate latched position. A differential drive couples the auxiliary rotor to the main rotor for effecting relative rotational movement thereof. Key information sensing elements sense the key information during the relative rotational movement of the auxiliary rotor and are repositioned thereby, and these elements are taken along by the main rotor rotation at the end stage of the relative movement to remove them from contact with the key and return them to a rest position. Lock information elements are associated with the key information sensing elements, and the relative movements between these elements constitute a lock information stored in the lock. Pawls couple the key information sensing elements to the associated lock information elements to reposition the lock information elements according to the sensed key information. Controllable movable test elements are moved into sensing engagement with the repositioned lock information elements to determine whether the sensed key information conforms with the stored lock information. The test elements move bolts in the main rotor between an effective and ineffective position depending on whether the sensed key information conforms with the stored lock information or not.

12 Claims, 10 Drawing Figures

LOCK

The present invention relates to improvements in mechanical locks, and more particularly locks of the type comprising a stator having a cylindrical wall about a longitudinal axis and a lock cylinder mounted in the stator for rotation about the axis and defining a keyhole. A key carrying key information consisting of a plurality of information elements is insertable into the keyhole, and turning of the inserted key rotates the lock cylinder between angular positions corresponding to an open lock position and a closed lock position through an intermediate latched position, lock opening and closing being effected by rotating the lock cylinder in opposite directions. A like plurality of key information sensing elements each associated with one of the key information elements senses the associated key information element. If the sensed key information corresponds to a lock information stored in the latched position of the lock cylinder, a bolt means in the cylinder is moved into its ineffective position to enable the cylinder to be rotated into the open position.

Known mechanical locks of this general type have certain disadvantages. Some such locks, for instance, contain the lock information unchangeably in the key information sensing elements and this lock combination can be changed only by replacing the sensing elements if such change is desired because of security reasons. Also, the key can be removed from these locks only in the closed position of the lock, and since the lock information is contained in the sensing elements which can be reached through the keyhole, sensing of the lock information by unauthorized users is possible.

In other such known locks, the lock information is contained in the variable position of lock information elements which are completely separated from the key information sensing elements during sensing of the key information. Correspondence between the sensed key information and the lock information is then tested by comparing the information stored respectively in the lock information elements and the key information sensing elements. Such locks provide considerable security against tampering and unauthorized opening, and they have the additional advantage of making it possible to change the lock information by inserting a different key in the opened lock, i.e. such locks can "learn" new lock information. However, because the lock information and key information sensing elements are separated from each other during sensing of the key information and must be moved towards each other when the lock information is tested against the sensed key information, these locks must have large dimensions.

It is the primary object of this invention to overcome the latter disadvantage and to provide a lock of this general type which may be of small dimensions because no spatial separation and approach between the lock information and key information sensing elements is required. In this way, a "learning" lock of high security and small dimensions is provided, and the key may be removed from the keyhole in the open and the closed lock position.

This and other objects are accomplished in accordance with the invention with a lock comprising a stator having a cylindrical wall about a longitudinal axis, a main rotor mounted in the stator for rotation about the axis, the main rotor defining a keyhole, and a key carrying key information insertable into the keyhole, turning of the inserted key rotating the main rotor, which constitutes the lock cylinder, between angular positions corresponding to an open lock position and a closed lock position through an intermediate latched position, lock opening and closing being effected by rotating the main rotor in opposite directions, and the key information consisting of a plurality of information elements. An auxiliary rotor is mounted on the main rotor for rotation about the axis and relative to the main rotor in all but the latched angular position, and a differential drive is coupled between the main and auxiliary rotors for effecting relative rotational movement of the auxiliary rotor in the angular positions of the main rotor before and after the latched position. A like plurality of key information sensing elements each associated with one of the key information elements senses the associated key information element during the relative rotational movement of the auxiliary rotor, the sensing elements being pressed into contact with the key information elements by the auxiliary rotor and being repositioned by the key information elements. A lock information element is associated with each key information sensing element and movable therewith. The key information sensing elements and the associated lock information elements are mounted in the auxiliary rotor for adjustment relative to the axis, and the relative positions between the key information sensing elements and their associated lock information elements constitute a lock information stored in the lock, the key being removable from the keyhole in the open and closed positions due to the disengagement of the key information sensing elements from the key information elements. Pawls are effective to couple the key information sensing elements and the associated lock information elements together for common rotation at least during rotation from the closed to the intermediate latched position whereby the lock information elements are taken along with the rotating key information sensing elements and are repositioned according to the key information sensed by the sensing elements. A controllably movable test means is mounted on the auxiliary rotor and controlled to move into sensing engagement with the repositioned lock information elements to determine whether the sensed key information conforms with the stored lock information. A bolt means is mounted in the main rotor and is movable between an effective position in the latched position of the main rotor and an ineffective position, i.e. positions wherein the main rotor cannot and can be rotated. The test means is arranged to move the bolt means into the ineffective position if the sensed key information conforms with the stored lock information and thus enables the key to be turned further and to rotate the main rotor from the latched into the open lock position.

The above and other objects, advantages and features of the present invention will become more apparent from the following detailed description of now preferred embodiments thereof, taken in conjunction with the accompanying drawing wherein.

Figure 1:
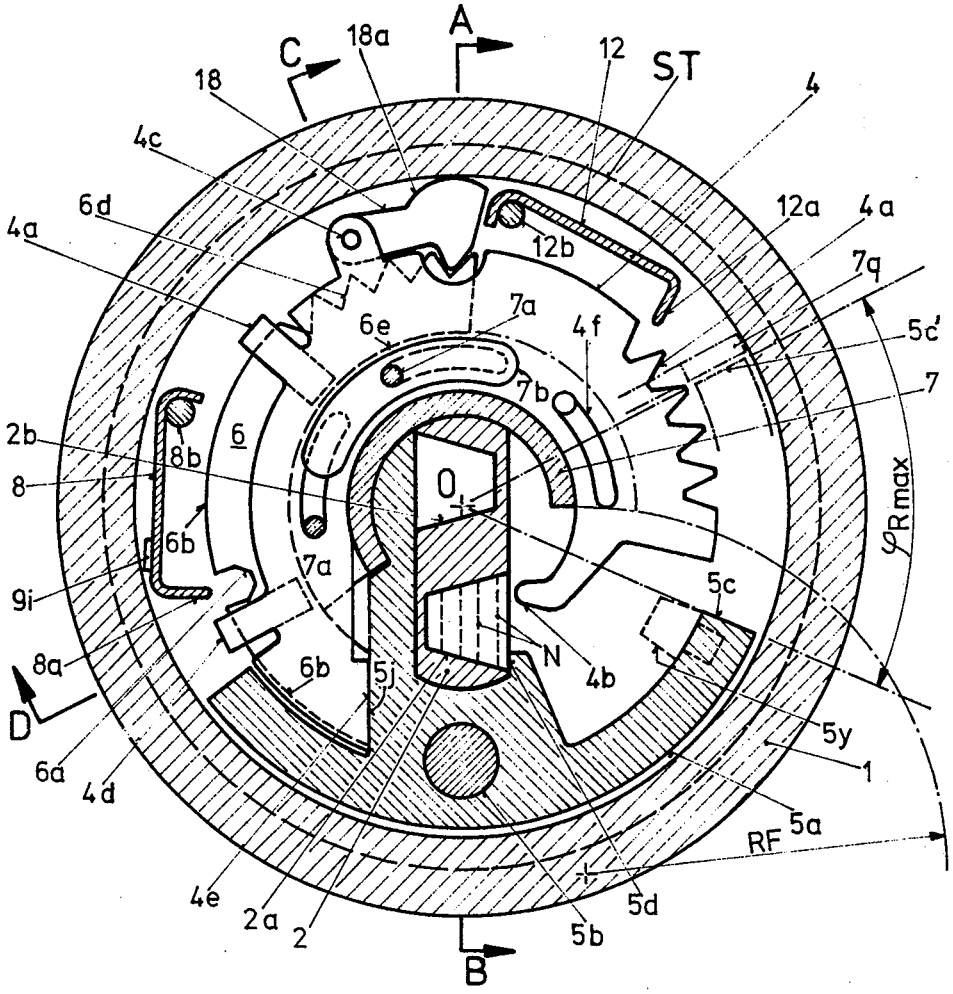
FIG. 1 is a transverse cross section through the lock, taken perpendicularly to the lock axis along line K—K of FIGS. 5 and 6.

Referring now to the drawing, it should be noted that parts of the same lock element are designated by the same numeral with subscripts attached thereto to indicate the respective parts of the element. The illustrated lock comprises stator 1 consisting of a metal cylinder having longitudinal axis O, which constitutes the lock axis, and front plate 1*e*, which may be welded to an end of the cylinder, defining a keyhole for the insertion of key 2 into the lock. Main rotor 5 is mounted coaxially in the stator for rotation about the lock axis, and auxiliary rotor 7 is mounted coaxially in the main rotor for rotation therewith and in relation thereto. The main rotor is held on the stator by annular spring 1*f* engaging a shoulder at the rear end of stator 1 and pressing against locking cylinder 5*g* of the main rotor. The stator and rotors are concentric with each other, the rotors being rotatable in the illustrated embodiment by inserted key 2 about axis O through an angle of 360° from an open position ZO to a closed position ZS (see FIG. 10), a simple stop (not shown) acting on the locking cylinder to prevent rotation beyond a full turn. As will appear hereinafter, key 2 can be inserted into, or removed from, the lock only in angular positions 0° and 360°, i.e. in the open or closed position of the lock. This position ZO or ZS is shown in the drawing.

Key 2 shown inserted into the lock in FIGS. 1, 3, 4 and 5 has non-variable key information 2*a* which, as shown in FIG. 1, consists of recesses in the lateral surfaces of the key, each recess constituting a separate key information. In the illustrated embodiment, the recesses have five respective steps or levels N. Key 2 is not shown in FIGS. 2 and 6.

Figure 5:
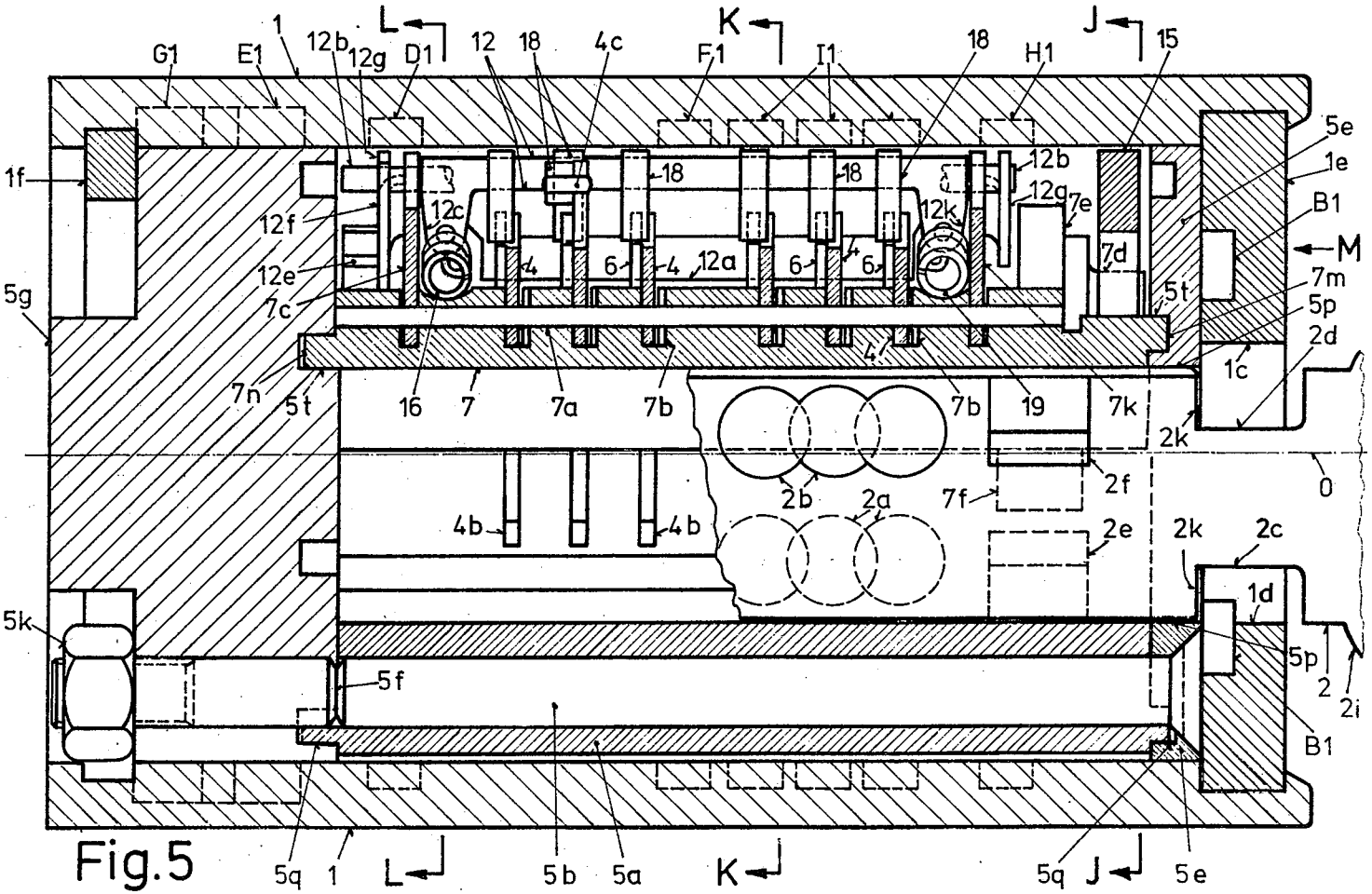
FIG. 5 is a longitudinal section taken along line A-O-B of FIGS. 1 to 3.

As best shown in FIG. 5, main rotor 5 consists essentially of axially elongated key guide 5*a*, rotor front plate 5*e* underlying front stator plate 1*e* and locking cylinder 5*g* at the rear of the rotor and axially aligned with front plate 5*e*. Rotor parts 5*a*, 5*e* and 5*g* are assembled and held together by eccentrically positioned bolt 5*b* extending through aligned bores in the rotor parts and held in position by nut 5*k*, the key guide defining circular grooves 5*q* at the opposite ends thereof to center the front plate and locking cylinder in respect thereto. Key guide 5*a* may be a drawn metal part.

Front plate 5*e* of the main rotor defines keyhole 5*p* dimensioned to enable the key to be inserted into the main rotor for rotating the rotor by turning the key.

Figure 10:
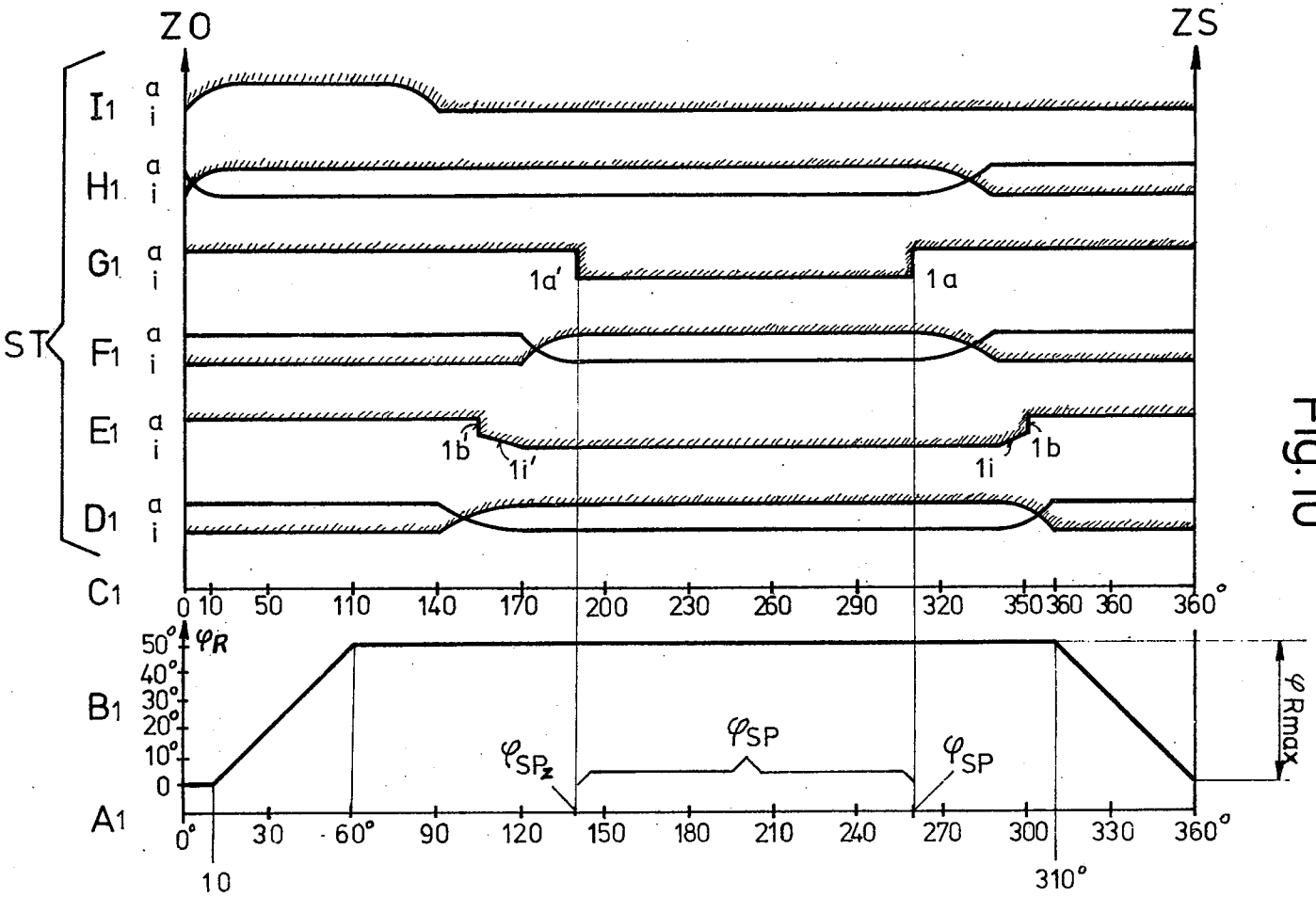
FIG. 10 shows a diagram of the control canvas for controlling the elements of the lock in the various angular positions of the lock rotors.

Auxiliary rotor 7 is rotatably mounted in main rotor 5, the auxiliary rotor being mounted in the main rotor by means of splines 7*m*, 7*n* extending into circular grooves 5*t* (see FIG. 5). The auxiliary rotor is rotated in relation to the main rotor by a differential drive to be described hereinafter in such a manner that it will make a full (360°) turn when the main rotor makes a full turn (FIG. 10) but will move relatively to the main rotor during the rotation. This relative motion between auxiliary rotor 7 and main rotor 5 is shown in FIG. 10 at $B_1$, being effected by cam $B_1$ milled into front plate 1*e* of the stator (see FIG. 5). The auxiliary rotor consists essentially of a metal cylinder, with splines extending from the ends thereof, a circumferential portion of which has been removed by a cutter of the radius $R_f$ (FIG. 1), which enables auxiliary rotor 7 to move relative to main rotor 5 by a maximum angle $\phi_{Rmax}$.

Figure 6:
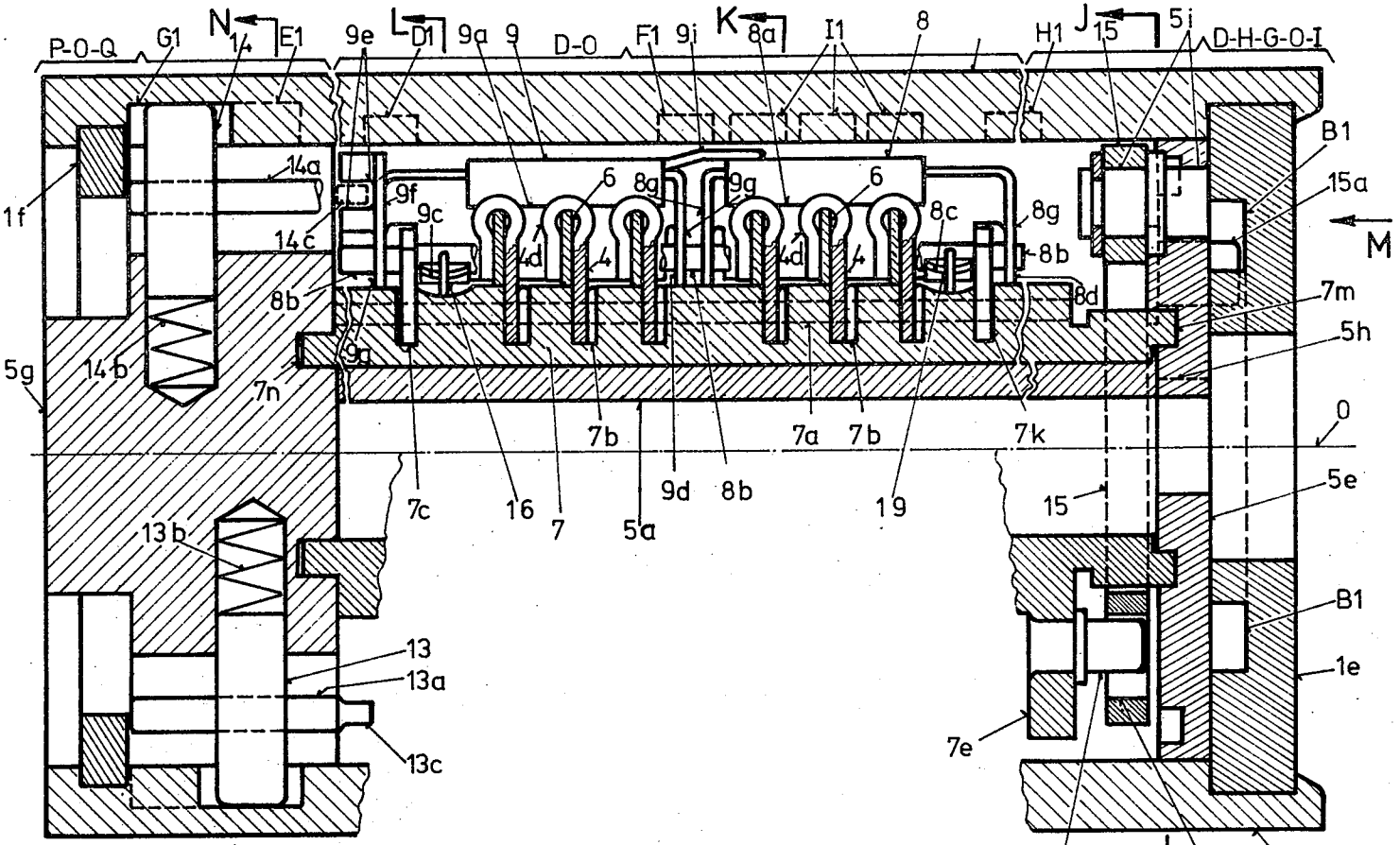
FIG. 6 is a composite sectional view of the lock, taken along lines D-H-G-O-I of FIG. 3, D-O of FIGS. 1 and 2, and P-O-Q of FIG. 2.

In addition to the stator and rotors, the lock comprises key information sensing elements 4, the configuration of one such element being shown in heavy outline in FIG. 1. Elements 4 are substantially flat annular disc sectors mounted concentrically about lock axis O and being axially spaced, as shown in FIGS. 5 and 6. These key information sensing elements may be stamped sheet metal pieces mounted in grooves in auxiliary rotor 7 for rotation about the lock axis. They are held in position by rods 7*a* extending axially through the auxiliary rotor and passing through elongated arcuate slots 4*f* in elements 4. This mounting prevents the key information sensing elements from moving radially but permits a relative angular movement between elements 4 and auxiliary rotor 7 to an extent necessary for sensing the key information. Leaf springs 7*b* press elements 4 against the wall of the grooves in the auxiliary rotor and thus frictionally engage the key information sensing elements with auxiliary rotor 7 during their relative movement.

Steps N of key informations 2*a* are sensed by sensing points or noses 4*b* of the key information sensing elements (see FIG. 1). The sensing element cooperating with a respective one of the key informations has a number of adjacent notches 4*a* corresponding to the possible steps N in the respective key information, i.e. five notches in the illustrated embodiment. A latch 12 is common to all elements 4 and has a latch portion 12*a* for latching engagement with respective notches 4*a*. The latch is pivotal about axially extending shaft 12*b* mounted on auxiliary rotor 7 and locks all elements 4 against rotation when latch portion 12*a* engages notches 4*a*.

The key information sensing elements have bearings 4*c* circumferentially spaced from the array of notches 4*a* for pivotally mounting coupling pawls 18 which are taken along with elements 4.

Return of the key information sensing elements into the zero or rest position shown in FIG. 1 (i.e. the open or closed position of the lock) is effected by engagement of end faces 4*e* of elements 4 with abutment 5*j* on main rotor 5 (see FIG. 1).

A lock information element 6 is associated with each key information sensing element 4, the lock information elements being correspondingly axially spaced from each other. These elements are substantially flat annular disc sectors mounted concentrically about lock axis O. As best shown in FIG. 6, the elements 6 are held in frictional engagement with their associated sensing elements 4 by means of bent-over lugs 4*d* extending radially from the periphery of elements 4 and providing a guideway for elements 6. The inner arcuate ends 6*e* of lock information elements 6 rest on the periphery of auxiliary rotor 7, and these elements are movable relatively to elements 4 about the lock axis.

The lock information consists of the sum of all relative positions between key information sensing elements 4 and lock information elements 6. During rotation of elements 4, elements 6 are taken along by the frictional force between elements 6 and lugs 4*d*, on the one hand, and may be fixedly coupled to element 4 by engaging pawl 18 with a notch 6*d* in element 6, on the other hand. A number of fixed relative positions between elements 4 and 6 corresponding to the number of steps N in the key information is provided by notches 6*d*, the illustrated embodiment showing five such positions determined by five notches 6*d* for respective engagement with pawl 18.

The arcuate periphery of lock information elements 6 has two peripheral portions 6*b*, 6*b* circumferentially spaced from the array of notches 6*d* and defining therebetween a test notch 6*a* (see FIG. 1) engageable respectively by latch portions 8*a* and 9*a* of axially spaced test elements 8 and 9 pivotal about shaft 8*b*. As best shown in FIGS. 5 and 6, test elements 8, 9 and latch 12 are sheet metal latches which are pivotal in respective planes extending perpendicularly to the lock axis about respective shafts 8*b* and 12*b* to engage respective latch portions 8*a*, 9*a* and 12*a* in associated notches of key information sensing elements 4 and lock information elements 6, shafts 8*b* and 12*b* being respectively mounted on auxiliary rotor 7 by means of bearing plates 7*c*, 7*k*. The sheet metal latches are carried on yokes 8*g*, 9*g* and 12*g*, respectively, which are pivotally mounted on the shafts. The bearing plates are held in slots in the auxiliary rotor by means of the rods 7*a* which pass therethrough, thus being fixed to the auxiliary rotor for rotation therewith.

Spring 16 is mounted between lever arm 9*c* of test element 9 and lever arm 12*c* of latch 12, the spring being biased to pivot latch portions 9*a* and 12*a* into associated notches 6*a* and 4*a*, and to press cam follower 9*d* affixed to test element 9 and cam follower 12*d* affixed to latch 12 respectively into cam grooves F1 and D1 which are milled into the inner wall of stator 1. Since cam follower 9*d* is associated with cam F1 (see FIGS. 5 and 6), and therefore, cannot be seen in the section of FIG. 2, it has been shown therein in broken lines.

Figure 2:
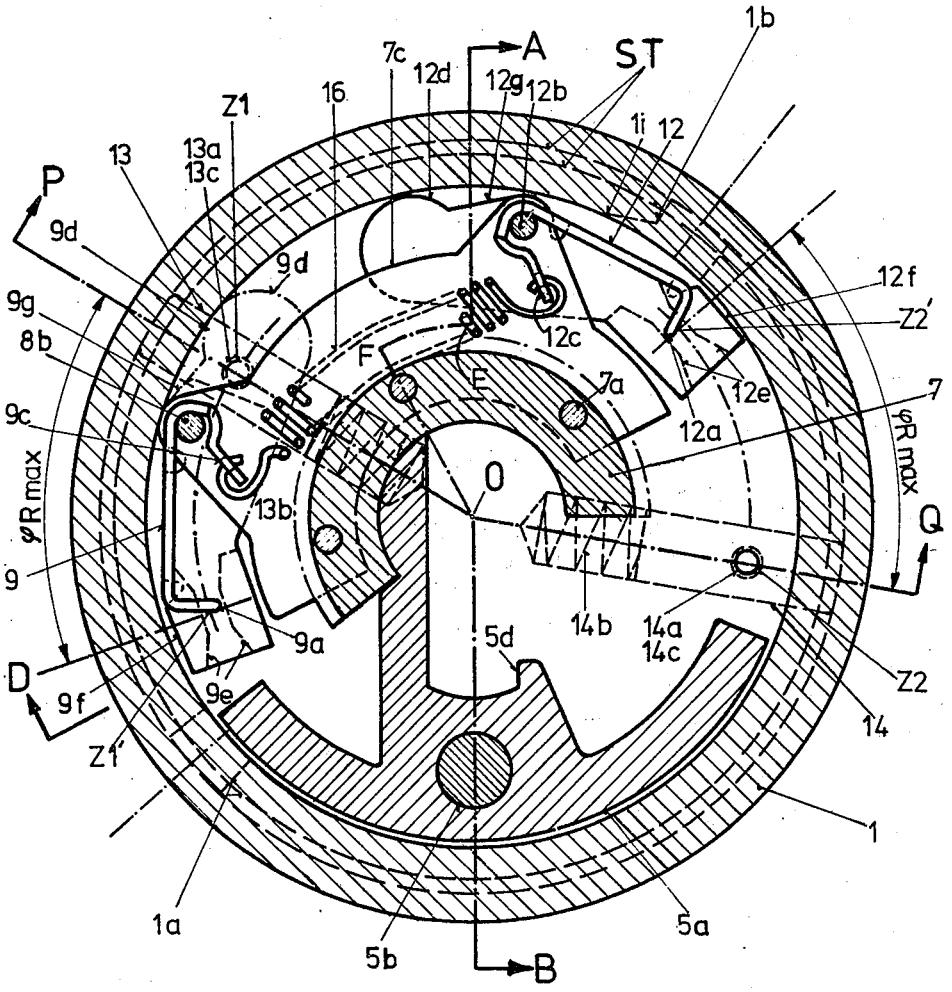
FIG. 2 is a like cross section taken along line L—L of FIGS. 5 and 6.

FIG. 5 also shows spring 19, which has the same position as shown for spring 16 in FIG. 2, and biases lever arm 12*k* of latch 12 and lever arm 8*c* of test element 8 in a like manner, thus reinforcing the bias on latch 12 and biasing element 8 so that its latch portion 8*a* engages associated notch 6*a* and its cam follower 8*d* is pressed into cam groove H1 milled into the inner wall of the stator.

As shown in FIG. 6, the illustrated lock has six axially spaced key information sensing elements 4 associated with six lock information elements 6 mounted on auxiliary rotor 7. Six correspondingly axially spaced key information recesses 2*a* are defined in the lateral surfaces of key 2, each recess 2*a* being sensed by a respective nose 4*b* of an associated sensing element when the key has been inserted in the lock (see FIG. 5). All key information sensing elements are locked in a controlled angular position by common latch 12 when the latch portion 12*a* engages notches 4*a*.

In the illustrated embodiment, two test elements are provided, element 8 testing the position of the three lock information elements 6 at the right side of FIGS. 5 and 6 while element 9 tests the position of the three other elements 6, latching portions 8*a* and 9*a* either engaging test notches 6*a* or riding on peripheral portions 6*b* of elements 6. The two test elements are separately controlled by cams H1 and F1, as indicated hereinabove and will be described in detail hereinafter.

Follower 9*a* is affixed to test element 9 and is so arranged that test element 9 cannot lockingly engage the elements 6 associated therewith when test element 8 does not so engage its associated elements 6. On the other hand, test element 8 may lock its elements 6 even when test element 9 is disengaged.

Figure 9:
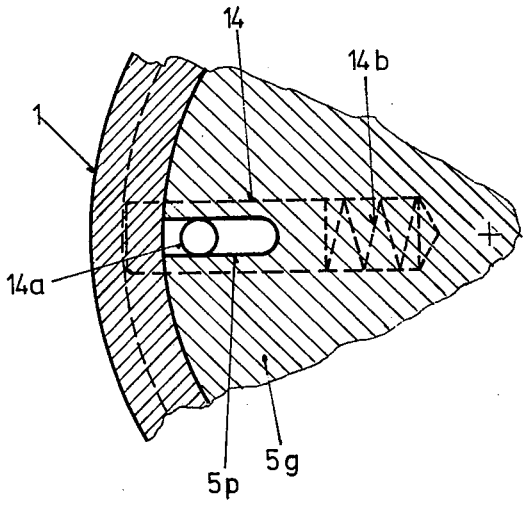
FIG. 9 is a partial section along line N of FIG. 6.

As shown in FIGS. 2, 6, and 9, locking cylinder 5*g* of main rotor 5 defines circumferentially spaced radial bores housing radially slidable locking bolts 13 and 14 outwardly biased by weak coil springs 13*b*, 14*b*. The sole purpose of these springs is to hold the locking bolts in the illustrated, radially extended position in the absence of controlled action. In a practical embodiment, the inner ends of the locking bolts have a tubular extension housing the springs so as to increase the guide length of the locking bolts and to prevent jamming of the lock. Locking bolts 13 and 14 carry keeper pins 13*a* and 14*a* extending in an axial direction. Constricted end 13*c* of keeper pin 13*a* can be engaged by fork 9*e* of test element 9 and locking bolt 13 may thus be radially moved by this test element. Constricted end 14*c* of keeper pin 14*a* may be engaged by fork 12*e* of latch 12 to move locking bolt 14 radially. Fork 9*e* is affixed to leg 9*f* of yoke 9*g* and fork 12*e* is affixed to leg 12*f* of yoke 12*g*.

The differential drive enabling relative angular movement between the main and auxiliary rotors will now be described with particular reference to FIGS. 3 and 6. This drive comprises lever 15 whose one end is pivotally journaled on fulcrum shaft 5*i* affixed to the main rotor, the fulcrum shaft being mounted in the illustrated embodiment on main rotor front plate 5*e*. The fulcrum shaft extends in the axial direction to enable differential drive lever 15 to be pivoted in a plane extending perpendicularly to the lock axis O. The other end of arcuately shaped lever 15 defines slot 15*b* receiving keeper pin 7*d* affixed to projection 7*e* extending from auxiliary rotor 7.

Figure 3:
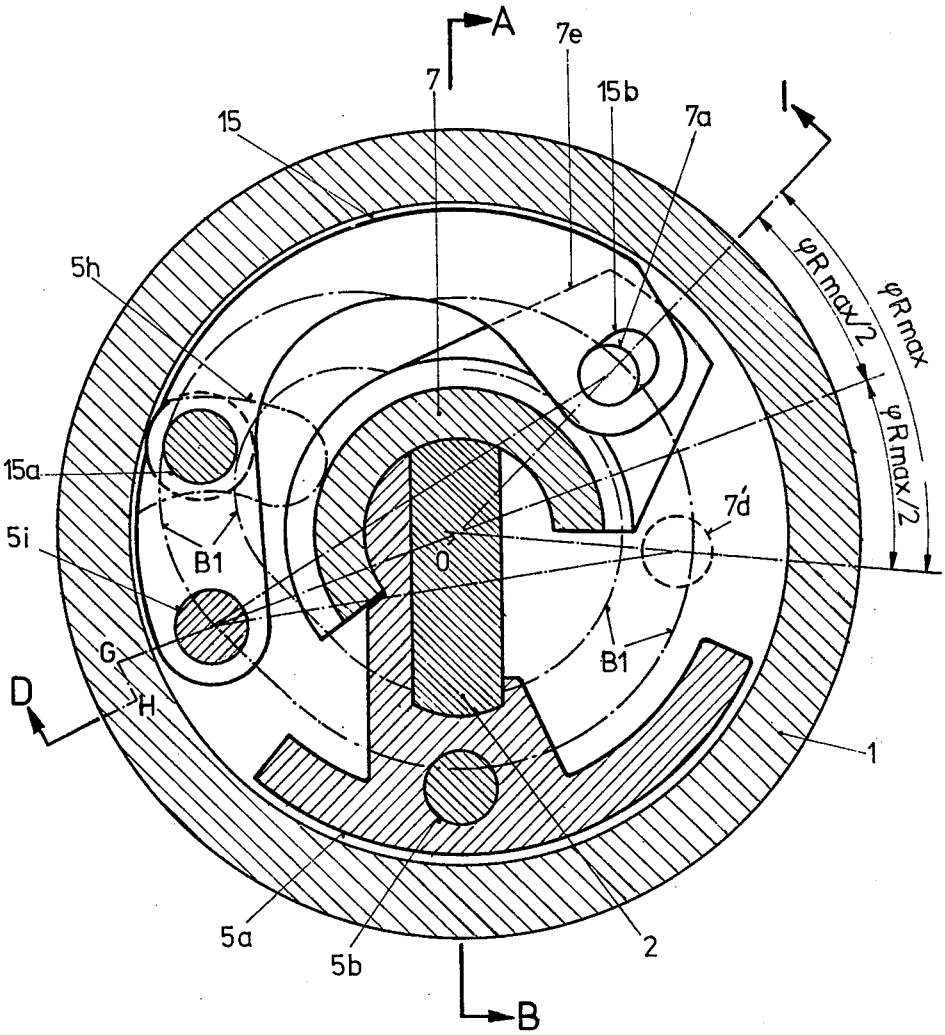
FIG. 3 is another like cross section taken along line J—J of FIGS. 5 and 6.

Referring to FIG. 3, when differential drive lever 15 is pivoted about fulcrum 5*i* downwardly, i.e. clockwise, auxiliary rotor 7 is able to move relative to main rotor 5 by the maximum angle $\phi_{Rmax}$. Lever 15 also carries cam follower bolt 15*a* engaging cam $B_1$ milled into the stator front plate 1*e* and being controlled thereby. Cam $B_1$ is shown in chain-dotted lines in FIG. 3 because it is not visible in a sectional view along line J—J. Because also invisible in this section, opening 5*h* in front plate 5*e* is shown in a dotted line in this figure.

During a full rotation of main rotor 5, differential drive lever 15 is so controlled by cam follower bolt 15*a* moving in cam $B_1$ that it is pivoted in one direction at the beginning of the turn and in the opposite direction at the end of the turn so that the auxiliary rotor angularly moves in relation to the main rotor by $\phi_{Rmax}$. The curve of this relative motion as a function of rotation $A_1$ of the main rotor is shown at $B_1$ in FIG. 10.

While it has not been illustrated, it will be useful to mount a spring between fulcrum shaft 5*i* of differential drive lever 15 and keeper pin 7*d* to fix the auxiliary rotor relative to the main rotor in the two end positions determined by angle $\phi_{Rmax}$ and to press the auxiliary rotor against stops (also not shown) between the auxiliary and main rotors. This permits accurate maintenance of the relative end positions and correspondingly accurate operation of the lock without dependence on the accuracy of control cam $B_1$. At the same time, such a spring will hold the main rotor at rest in the open and closed positions of the lock.

Figure 4:
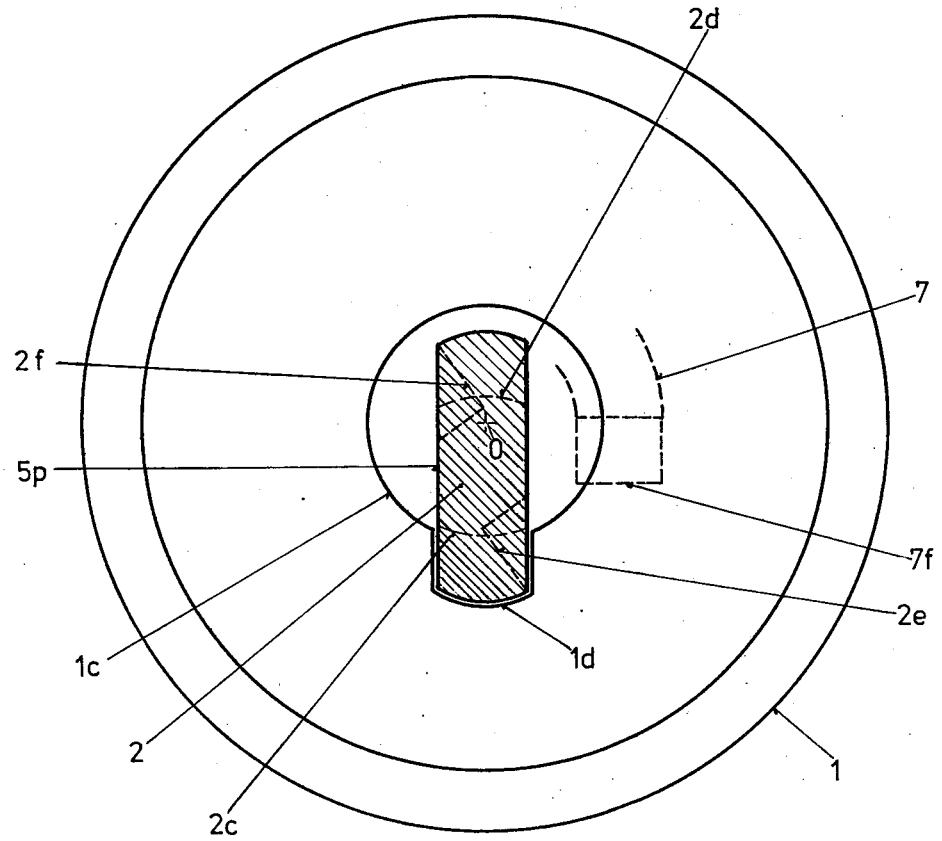
FIG. 4 is a front end view of the lock, taken in the direction of arrow M of FIGS. 5 and 6.

As shown in FIG. 4, the cross section of keyhole 5*p* in main rotor front plate 5*e* corresponds to the transverse cross section of key 2 so that the key fits into the keyhole. Front plate 1*e* of stator 1 defines circular opening 1*c* concentric about lock axis 0, opening 1*c* having a radially extending slot 1*d* in alignment with keyhole 5*p*, openings 1*c* and 1*d* preventing key 2 from being withdrawn during opening and closing of the lock (see also FIG. 5). As will be seen from FIGS. 4 and 5, these openings in cooperation with shoulders 2*k* of the key will enable the key to be inserted into the lock and to be withdrawn therefrom only in the fully open or fully closed position. Neck 2*c* in key 2 permits the key to be turned 360° without being stopped by slot 1*d* in the stator front plate. Shoulder 2*k* prevents withdrawal of the key during turning.

As seen in FIG. 1, the key information is provided on both flat side faces of key 2 in the form of recesses 2*a*, 2*b*. This permits the key to be inserted in two positions, i.e. a first position and a second position, in which the key has been turned by 180°. To prevent the key from being withdrawn after a 180° turn, it has notches 2*e* and 2*f* (FIGS. 4 and 5), projection 7*f* affixed to auxiliary rotor 7 engaging one of these notches and thus preventing withdrawal of the key before the lock is in its zero position.

Operation of the lock is controlled by cams $B_1$ milled into the front plate of the stator and cams $D_1$ to $I_1$ milled into the inner wall of the cylinder of the stator, the latter being designated as controls ST and the cams as a function of the angular position of the rotors being shown in the diagram of FIG. 10. The cams are shown in broken lines in FIGS. 1, 2, 5, and 6.

Beginning with open position ZO (0°), the main rotor 5 and auxiliary rotor 7 rotate in synchronism up to 10°, whereupon a relative movement of 50° occurs between the rotors in the range between 10° and 60°, auxiliary rotor 7 running ahead of main rotor 5 by 50° until it has been rotated through an angle of 60° + 50° = 110°. The two rotors then rotate synchronously again until the main rotor has been turned 310°, at which point another relative movement of 50° begins during which main rotor 5 turns the remainder of a full rotation to closed positions ZS (360°) while the auxiliary rotor stands still, i.e. lags behind. The respective positions of auxiliary rotor 7 during a full 360° turn of main rotor 5 are shown in line $C_1$ of FIG. 10. The maximum angle of the relative movement is designated as $\phi_{Rmax}$ and is 50° in the illustrated embodiment of the control.

During the closing movement from open position ZO to closed position ZS in the range of 10° to 60°, i.e. during the first relative movement between the main and auxiliary rotors, key information sensing elements 4 sense key information 2*a* or 2*b*. The same happens during the opening movement from closed position ZS to open position ZO in the range of 360° to 310°, i.e. during the relative movement between the rotors. No such relative movement occurs during rotation of main rotor 5 between 60° and 310°, durng which stage of operation the key information sensing elements are engaged in the information recesses of the key. In the ranges between 310° to 360° and between 60° and 10°, i.e. during the relative movement between the rotors, the key information sensing elements are not engaged with the key information recesses so that the key may be inserted and withdrawn in the open and the closed position of the lock. The lock can be unlocked only when the test elements are in engagement with the lock information element.

Cam $I_1$ controls the operation of coupling pawl 18 which locks the key information elements 4 and associated lock information elements 6 together.

Cam followers 8*d*, 9*d* and 12*d* of test elements 8, 9 and latch 12 are controlled by cams $H_1$, $F_1$ and $D_1$, respectively, as described hereinabove, to move respective latch portions 8*a*, 9*a* and 12*a* inversely to the movement of the cam followers, the test elements and latch being constituted by two-armed levers pivotal about respective fulcrum shafts 8*b* and 12*b*. The cam followers follow the curves of their cams so that the latch portions move radially inwardly when the cam followers move outwardly. Thus, cam diagrams $D_1$, $F_1$ and $H_1$ in FIG. 10 show two inversely running curves, the hatched curve showing the movement of the cam follower in the associated cam and the nonhatched curve illustrating the inverse movement of the latch portions, the letter *a* indicating "outward" and *i* indicating "inward" in respect of lock axis O.

In the illustrated zero position of the lock, which corresponds to its open and its closed position, locking bolts 13 and 14 are circumferentially spaced from forks 9*e* and 12*e* designed to engage keeper pins 13*a* and 14*a* of the bolts by maximum angle $\phi_{Rmax}$ of the relative movement between the lock rotors. After each relative movement has been terminated, i.e. at an angular position of 60° during the closing movement and a 310° position of the main rotor during the opening movement, centers $Z_1$ and $Z_2$ of the keeper pins have been moved into positions $Z_1'$ and $Z_2'$ by maximum angle $\phi_{Rmax}$, as shown in FIG. 2. This places them into engaging position with associated forks 9*e* and 12*e*. Thus, the locking bolts remain coupled to test element 9 and latch 12, respectively, during rotation of main rotor 5 in the range of 60° to 310°, see FIG. 10. In this range, the radial movement of sliding bolts 13 and 14 is controlled by test element 9 and latch 12.

Bolt 14, which is controlled by latch 12, moves in cam groove $E_1$ milled into the cylinder of the stator between stops 1*b* (shown in FIG. 2) and 1*b'* (not shown in FIG. 2 but appearing in FIG. 10), the angular distance between the two stops being indicated in FIG. 10. Between the two stops, bolt 14 is radially inwardly pressed by cam $E_1$ and retains latch 12 in the engaged position.

Bolt 13, which is controlled by test element 9, moves in cam groove $G_1$ in the stator cylinder between stops 1*a* (shown in FIG. 2) and 1*a'* (not shown in FIG. 2), the angular distance between shoulders or the two stops being illustrated in FIG. 10. Between these two stops, i.e. in the entire range $\phi_{SP}$ constituting the latched angular position of the main rotor, sliding bolt 13 is radially inwardly pressed by cam $G_1$ and retains test element 9 as well as test element 8 coupled thereto by follower 9*i* in the engaged position.

During opening, the lock operates as follows:

At the beginning, main rotor 5 is in closed position ZS, i.e. at 360°, and it is turned counterclockwise to open position ZO, i.e. from right to left in the diagram of FIG. 10. At the beginning of the opening movement, i.e. in position ZS, the lock parts are in the position shown in FIGS. 1 to 3. Depending on the lock information, lock information elements 6 could be in positions different from that illustrated in FIG. 1.

During the first stage of the counterclockwise rotation of the main rotor from 360° to 310°, the previously described relative movement of the rotors (50° in the illustrated embodiment) causes the auxiliary rotor 7 to stand still. Thus, looking at FIG. 1, the auxiliary rotor and its latch 12 and test element 8, remain stationary until main rotor 5 has been turned by angle $\phi_{Rmax} = 50°$ and end face 5*c* of the main rotor has reached position 5*c'* (shown in broken lines in FIG. 1). While key 2 thus turns the main rotor in relation to the stationary auxiliary rotor, the key information is sensed by pressing the key against sensing noses 4*b* of key information sensing elements 4. This causes elements 4 to be moved relative to the auxiliary rotor against the friction force exerted upon them by springs 7*b* and in accordance with the sensed level or step N of key information recesses 2*a*. At the end of this operating stage, the changed position of the key information sensing elements relative to the auxiliary rotor contains the key information.

As the rotation of the main rotor continues (left in FIG. 10), cam $D_1$ pivots latch 12 to engage its latch portion 12*a* with notches 4*a* of the repositioned key information sensing elements. If steps N in recess 2*a*, 2*b* are not properly matched, latch portions 12*a* could come to rest at a crest between notches 4*a*, instead of engaging a notch, so that latch 12 is not engaged and sliding bolt 14 coupled to the latch is stopped at shoulder 1*b* (FIGS. 2 and 10) as rotation of the main rotor is continued, thus preventing further rotation. Thus, while the key information steps need not be absolutely accurate, they must be so shaped that latch portion 12*a*, of latch 12 will enter at least about half into notches 4*a*. The engaged latch will then cause bolt 14 coupled thereto to be sufficiently pressed inwardly so that the outer surface of the bolt will ride on oblique portion 1*i* (FIG. 2) so that cam $E_1$ will press the bolt and the latch coupled thereto radially inwardly to permit further rotation, the key information sensing elements 4 being locked in position by latch 12 against further movement from the outside.

It will be useful if noses 4*b* engage key information recesses 2*a* with a little resilience so as to prevent damage to any part when latch 12 locks elements 4.

As the rotation of main rotor 5 continues beyond stop 1*b*, cam $H_1$ causes test element 8 to be pivoted into its locking position while cam $F_1$ causes test element 9 to be pivoted into its locking position. These locking movements proceed readily when test notches 6*a* of all lock information elements 6 are in radial alignment with latch portions 8*a* and 9*a* of the test elements. This is the case when the key information sensed during the opening movement, which conformingly moves the key information sensing elements in the above-described manner, conforms to the lock information. The latter, as indicated hereinabove, consists of the sum of all the relative positions between elements 4 and 6. Corresponding to the five sensing steps in key 2, the lock information has five possible parameters and is characterized by that notch 6*d* which is engaged by coupling pawl 18. In FIG. 1, outermost notch 6*d* is shown engaged by pawl 18. If the pawl engaged instead the center notch, test notch 6*a* would be properly aligned with latch portion 8*a* of test element 8, i.e. would permit engagement of the latch portion with the notch, if sensing element 4 would also be centered in respect of latch 12 when nose 4*b* senses the key information.

During sensing of the key information and the further angular movement of the main rotor, pawls 18 couple elements 4 and 6 together so that the lock information elements are turned by the same angle as the key information elements. If the lock information and key information do not match for any element, the associated test element cannot engage test notch 6*a* but will ride on peripheral portions 6*b*. This causes the sliding bolt coupled to test element 9 to remain in its radially outward locking position shown in FIGS. 2 and 6, thus preventing rotation of the main rotor beyond stop 1*a*. Thus, the main rotor cannot be turned beyond range $\phi_{SP}$ between $\phi_{SP_1}$ and $\phi_{SP_2}$ (see (FIG. 10), and the lock cannot be opened. The lack of latching movement of test element 8 is transmitted to test element 9 by follower 9*i* and, therefore, to bolt 13.

When the lock information and the key information match, pivoting test element 9 causes sliding bolt 13 to be pressed radially inwardly so that it may pass by stop 1*a*, thus bridging the latching position of the lock and permitting main rotor 5 to be turned to opened position ZO (0°). In this stage of the opening movement from latching position $\phi_{SP}$ to opened position ZO, the following movements take place:

Shortly after angular position $\phi_{SP}$ (FIG. 19) has been passed, cam $F_1$ will pivot test element 9 to disengage the same from lock information elements 6, and cam $D_1$ will then pivot latch 12 to disengage it from key information sensing elements 4. The unlatched key information sensing elements will now be returned to their illustrated original position as the two rotors go through their relative movement from 60° to 10°, and faces 4*e* of elements 4 being taken along by abutment of stop 5*j* of the rotating main rotor. The lock information elements 6 associated with test element 9 (the three leftmost elements in FIGS. 5 and 6) remain coupled to associated key information elements 4 during the entire rotation of the main rotor by means of pawls 18 so that the lock information is not changed. Thus, the lock information remains constant in the open and closed positions of the lock.

On the other hand, the lock information elements associated with test element 8 (the three rightmost elements in FIGS. 5 and 6) are uncoupled in the range of the relative movement between the main and auxiliary rotors, i.e. between 60° and 10°, and remain connected to the associated key information elements only then the relatively small frictional force provided by bentover lugs 4*d*. The cam controlled pawls 18 ride unhindered over notches 6*d* in this angular range. FIG. 10 shows that cam $I_1$, which controls the pivotal movement of the pawls, permits the pawls to be pivoted freely outwardly in this range.

Cam $H_1$ pivots test element 8 into its engaged position during the relative movement of the rotors, i.e. in the angular range between $\phi_{SP}$ and 10°, thus being locked with elements 6 associated therewith during the return of elements 4 into the zero position shown in FIG. 1. Thus, the relative position between the elements is the same for all elements during the open position, and the lock contains no information. During the final rotational movement of the main rotor between 10° and 0°, test element 8 is pivoted by cam $H_1$ to be disengaged while cam $I_1$ couples pawls 28. In this manner, the cam condition is the same at 0° and 360°.

During closing, the lock operates in the following manner:

At the beginning, the rotor 5 is in the open position ZO, i.e. at 0°, and it is turned clockwise to closed position ZS, i.e. from left to right in the diagram of FIG. 10. At the beginning of the closing movement, i.e. in the position ZO, the lock parts are in the position shown in FIGS. 1 to 3, except possibly for the position of the lock information elements, which depends on the lock information, as described in connection with the operation during opening of the lock.

During the first stage of the clockwise rotation of the main rotor from 0° to 10°, the cam $H_1$ pivots test element 8 into notches 6*a* of lock information elements 6 associated therewith, cam $I_1$ uncoupling at the same time associated pawls 18. During the subsequent stage of rotation between 10° and 60°, wherein auxiliary rotor 7 precedes main rotor 5 in the clockwise direction by 50°, the key information is sensed by the relative movement between the key information sensing elements and the auxiliary rotor corresponding to the lock information described hereinabove in connection with the opening movement of the lock. Since lock information elements 6 associated with test element 9 are coupled to key information sensing elements 4, they are taken along therewith. The lock information elements associated with test element 8, on the other hand, are held against relative movement in relation to rotor 7 by the test element engaged therewith while the key information sensing elements move whereby a new relative position between elements 6 and 4 is produced, which constitutes a new lock information corresponding to the sensed key information. As the main rotor is turned beyond 60°, cam $I_1$ pivots pawsl 18 into notches 6d, elements 4 and 6 remaining coupled together for the rest of the closing movement.

As the rotation of the main rotor continues approximately to 90°, cam $D_1$ pivots latch 12 into engagement with the repositioned key information elements. Analogously to the description of the opening movement, the key information steps must be accurate enough to enable latch portion 12*a* to enter at least about half into notches 4*a* so that sliding bolt 14 is not blocked by shoulder or stop 1*b'* of cam $E_1$. Otherwise, oblique portion 1*i'* of cam $E_1$ will engage bolt 14 and pivot latch 12 into notches 4*a* so that the key information elements remain locked in position by latch 12 during the subsequent latching position range $\phi_{SP}$.

In this range, at about 120°, cam $F_1$ will pivot test element 9 in notches 6*a* of lock information elements 6 if, as also explained in connection with the opening movement, the sensed key information corresponds with the lock information. If key and lock information match, the main rotor may be turned beyond stop 1*a'* and angular range $\phi_{SP}$ into the closed position. Otherwise, test element 9 will ride on peripheral portions 6*b* of the lock information elements, sliding bolt 13 remains radially extended to be stopped by shoulder 1*a'*, and further rotation of the main rotor into the closed position is prevented.

The key information associated with those key information sensing elements 4 associated with test element 8 may be of any type since it is received automatically by these elements, i.e. it is "learned" by them. Thus, a portion of the lock information is fixed while another portion thereof is automatically "learned" from the key during the locking movement.

Cams $F_1$ and $H_1$ will pivot the test elements out of latching engagement as the closing movement of the main rotor is continued, whereupon the key information sensing elements are unlatched by pivoting latch 12, and the subsequent relative movement of the rotors causes the return of the key information sensing elements into the zero position shown in FIG. 1. In the closed position, the entire lock information is stored inside the lock and subsequent opening of the lock can be effected only with a key whose information fits the stored lock information.

The manufacture of the herein described and illustrated lock may advantageously proceed in the following manner:

Cams $B_1$ and $D_1$ to $I_1$ may be milled into the stator by a suitably programmed milling apparatus.

Auxiliary rotor 7 and lock information elements 6 mounted thereon may be of relatively weak construction since they are subjected only to weak forces, the major torque during the opening and closing movement being absorbed by main rotor 5.

As shown in FIG. 5, bolt 5*b*, which interconnects main rotor parts 5*a*, 5*e* and 5*g*, may have a constricted or weakened portion 5*f* which will break when a metal piece inserted into the key hole subjects the main rotor to excessive torque in the closed position of the lock. When such a break occurs, the main rotor portions 5*a* and 5*e*, with auxiliary rotor 7, may be freely turned without rotating locking cylinder 5*g*, which has been detached from the main rotor by the break. Thus, the lock will not be opened by such rotation. Provision of the weakened portion in main rotor connecting bolt 5*b* makes it possible to dimension locking bolts 13 and 14 so that they need not be able to resist very large forces. On the other hand, even when bolt 5*b* is broken, the correct key will open the lock.

It will be useful to make bolt 5*b* readily replaceable.

As shown in broken lines in FIG. 1, blocking wall 7*q* may be built into auxiliary rotor 7 to prevent sensing the relative position of the lock information elements through the keyhole.

As also shown in broken lines in FIG. 1, pins 5*y* may be inserted adjacent main rotor face 5*c* in association with selected key information sensing elements to make the lock information at these points ineffectual. This makes it possible to form lock groups and "pass" groups of key information sensing elements.

Obviously, the number of key information sensing elements may be varied from the illustrated six and that of the key information steps per sensing element from the illustrated five.

For all combinations, i.e. each one of the different lock informations, the lock consists of exactly the same parts. Even the lock information elements with fixed lock information are provided with pawls 18 and this information is then pre-set at the time of the lock assembly by engaging pawl 28 with selected notches 6*d* of these elements.

Since the test elements can engage lock information elements 6 only when key information sensing elements 4 have been locked in position, jiggling of elements 4 from the outside of the lock will produce no indication which elements 6 are engaged by a test element. The bias of the test element towards the lock information elements is transmitted therefrom to the auxiliary rotor and not to the key informaton sensing elements. As shown in FIG. 1, the play of the latch portions of the test elements in the notches of the lock information elements exceeds that of the latch portion of the latch in the notches of the key information sensing elements.

This makes a mechanical detection of the lock information impossible.

An acoustic detection of the lock information can be prevented if elements 4 and 6 are in contact with each other in each position only at the same points, i.e. bent-over lugs 4*d*. Furthermore, the lock information elements could be made of a relatively soft material, such as a synthetic resin, since they are subjected to relatively small forces only.

The lock would operate effectively with a single test element instead of the two separately controlled test elements hereinabove described.

A weakened portion may be provided between sensing noses 4*b* and the remainder of sensing elements 4 so that these elements will break when subjected to excess force by an implement inserted through the key hole by an unauthorized person.

In the illustrated embodiment of the mechanical lock of the present invention, each key information sensing element 4 has a lock information element adjustably associated therewith. However, since the lock information associated with test element 9 remains unchanged, i.e. the relative positions of elements 4 and 6 remain the same during the entire opening and closing movement, it would be possible to build this lock information directly into these sensing elements. In this case, peripheral portions 6*b* of the lock information elements and notches 6*b* of the lock information elements and notches 6*a* therebetween would then be integral parts of key information sensing elements 4, i.e. the constant lock information would be contained in the angular position of the test notches of elements 4.

Figure 7:
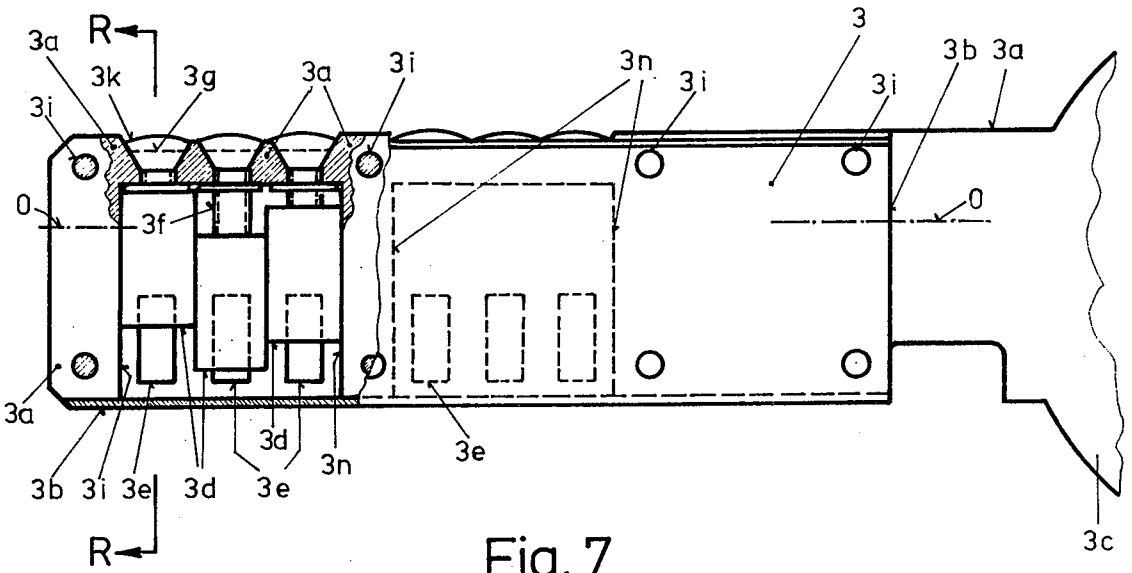
FIG. 7 shows an embodiment of an adjustable key, partially in side elevation and partially in longitudinal section.

Key 2 is a flat metal piece defining key information recesses 2*a*, 2*b* in the lateral walls of the key along the key axis. Such a key is very simple and its information is unchangeable. If the lock information is to be changed, a different key is inserted through the keyhole in the open position of the lock, a new lock information being then "learned" by the lock during the closing movement of the main rotor, as hereinabove described. If it were desired to change the lock information frequently, a considerable number of keys with different information (i.e. differently shaped recesses) will be required. This may be avoided by providing a single key with a variable information. Such a variable key 3 is shown in FIGS. 7 and 8.

In these figures, 0 designates the lock axis in relation to key 3 inserted into the lock. The key comprises a flat key body 3*a* and handle portion 3*c*, the key body defining milled portions 3*n* and being encompassed by U-shaped sheet metal part 3*b* affixed to the key body by rivets 3*i*. Slides 3*d* are mounted in the milled key body portions axially adjacent to each other and for sliding movement into and out of recessed portions 3*n*. Each slide corresponds to a key information sensing element 4 in the lock and can be sensed during the opening and closing movement of the main rotor by a respective sensing nose 4*b*.

Figure 8:
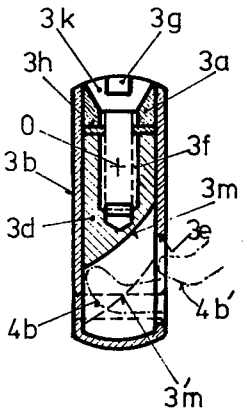
FIG. 8 is a cross sectional view of the key, taken along line R—R of FIG. 7.

Each slide may be moved perpendicularly to the lock axis by associated screw 3*f* and has an oblique and domed end face 3*m* which, when key 3 has been inserted through the keyhole, can be sensed through associated window 3*e* in sheet metal part 3*b* by nose 4*b*, as shown in FIG. 8. The screws have heads 3*k* slotted at 3*g* for engagement by a screwdriver and are held in an axially fixed position by rings 3*h* engaging a circumferential groove in the screws. In the upper position shown in full lines in FIG. 8, nose 4*b* may penetrate deepest into contacting engagement with end face 3*m* of the slide while a shallow engaging position 4*b'* is produced when the slide is moved into lower position 3*m'* indicated in broken lines by turning the screw.

Corresponding to the five steps N in the key information recesses of key 2, slides 3*d* may be moved into five positions providing five different penetrating depths for sensing nose 4*b*. It will be advantageous if the adjustment from one to the next step is accomplished by turning the screw either a full or a half turn. If a half turn is selected for adjustment from step to step and the screw head slots 3*g* run in the direction of the key axis in the uppermost position of the slides, the slots will run in this direction for all slide positions. This makes it possible readily to observe the proper adjustment of the screws and slides.

The key information may be changed by first turning the screws to drive the slides home and then effectuating the desired number of half turns to obtain the desired sensing levels. After all slides have been so adjusted, screw head slots 3*g* are examined to note whether they are aligned in an axial direction. Marking the position of slides 3*d* is not desirable to prevent unauthorized persons from obtaining the key information.

In the example illustrated in FIG. 7, six adjustable slides provide the key information for the six key information sensing elements 4 of the lock illustrated herein, sensing being effected through windows 3*e* which are desirably made as small as possible to prevent dirt from entering and also to make it more difficult to read the key information.

A miniature screwdriver may be held in key handle 3*c* for ready adjustment of the key slides. Rings 3*h* may be resilient to provide additional friction and thus to prevent unwanted slide movements.

Contrary to key 2, variable key 3 can be inserted only in one position while key 2 may be used equally in two positions removed from each other by 180°. If desired, a key may be used which has fixed information 2*a* along a portion of its length and variable information 3*d* along another key portion.

The variable key has the advantage of making changes in the key information very easy so that the lock combination can be readily changed with the adjusted key information in the above-indicated manner. Furthermore, the variable key can be made useless for opening of the lock by unauthorized persons by a few simple turns of screws 3*f*. Finally, it does away with a multiplicity of keys otherwise needed for changes in the lock information.

What is claimed is:

1. A lock comprising:

a. a stator having an inner wall of circular cross section defining an axis;

b. a main rotor mounted in said stator for rotation about said axis, 1. said main rotor defining an axially open keyhole therein;

c. a key carrying a plurality of key information elements, said key 1. being dimensioned for axial insertion into said keyhole and 2. including means for moving said main rotor about said axis between an angularly terminal, open lock position and an angularly terminal, closed lock position through an intermediate latched position when the inserted key is turned about said axis;

d. an auxiliary rotor mounted in said stator for rotation about said axis;

e. differential drive means coupling said main and auxiliary rotors for rotation of said auxiliary rotor relative to said main rotor during rotation of said main rotor into and out of said latched position, and coupling said auxiliary rotor to said main rotor for joint angular movement while said main rotor is in said latched position;

f. a plurality of key information sensing elements respectively associated with said key information elements, 1. said sensing elements being movably mounted on said auxiliary rotor for engagement by the respective associated key information elements during said rotation of said auxiliary rotor relative to said main rotor and for angular displacement from a starting position relative to the auxiliary rotor by the engaged key information elements, while said main rotor moves from one of said terminal positions toward said latched position;

g. abutment means on said main rotor for disengaging said sensing elements from the associated key information elements in response to movement of said main rotor from said latched position toward the other terminal position and for returning the disengaged sensing elements to said starting position;

h. a plurality of lock information elements associated with respective sensing elements, 1. said lock information elements being mounted on said auxiliary rotor for angular movement about said axis;

i. coupling means coupling said lock information elements to the associated sensing elements for joint angular movement responsive to movement of said main rotor from one of said terminal positions toward said latched position, whereby said lock information elements are positioned according to the key information elements engaged by said sensing elements, 1. the relative angular positions of said sensing elements and the associated, coupled lock information elements constituting stored lock information;

j. test means mounted on said auxiliary rotor and responsive to movement of said main rotor toward said latched position for engaging said positioned lock information elements and for thereby testing the engaged key information elements for conformity with said stored lock information; and k. bolt means mounted on said main rotor for movement between and effective position and an ineffective position, said bolt means when in said effective position preventing movement of said main rotor from said latched position into said open lock position, 1. said test means including means for moving the bolt means into said ineffective position in response to conformity of the engaged key information elements with said stored lock information.

2. The lock of claim 1, further comprising friction means arranged between the key information sensing elements and the associated lock information elements whereby the lock information elements are frictionally moved along with the key information sensing elements during rotation.

3. The lock of claim 1, wherein the key information sensing elements consist of flat annular disc sectors concentric about the axis, friction means being arranged between the key information sensing elements and the auxiliary rotor whereby the key information sensing elements are frictionally moved along with the rotating auxiliary rotor, each flat annular disc sector comprising a engaging nose at one end thereof for sensing the associated key information element, a face at the other end thereof for engagement with the abutment means on the main rotor.

4. The lock of claim 1, wherein the lock information elements consist of flat annular disc sectors concentric about the axis, each flat annular disc sector having an outer periphery defining two peripheral portions of equal radius and a test notch therebetween for engagement by said test means.

5. The lock of claim 4, further comprising a fulcrum shaft substantially parallel to the axis and mounting the test means on the auxiliary rotor for pivotal movement about the shaft, the test means comprising a latch portion pivotal substantially perpendicularly to the outer periphery of the lock information elements, and the bolt means comprising a bolt movable into its effective position by the test means sensing the peripheral portions and into its ineffective position by the test means engaging the test notch, means being provided for transmitting the pivotal movement of the test means to the bolt.

6. The lock of claim 1, further comprising a latch, a fulcrum shaft substantially parallel to the axis and mounting the latch on the auxiliary rotor for pivotal movement about the shaft to pivot the latch substantially perpendicularly to the key information sensing elements into peripheral notches therein, spring means biasing the latch at least partially into the notches, and the bolt means comprising a bolt movable into its effective position by the latch when the latch is not engaged with the notches to prevent further rotation of the main rotor in the direction of the latched position and into its ineffective position when the latch at least partially engages the notches to permit said further rotation, means being provided for transmitting the pivotal movement of the latch to the bolt.

7. The lock of claim 1, wherein the differential drive means include a lever having two ends, a fulcrum shaft substantially parallel to the axis mounting one of the lever ends pivotally on the main rotor near the periphery thereof, and the other lever end substantially diametrically opposite the one end in respect of the axis transmitting pivotal movement of the lever to the auxiliary rotor, and a control means in the stator for controlling the pivotal movement of the lever.

8. The lock of claim 1, wherein said test means include a test element and control means for moving the test element into sensing engagement with said lock information elements after engagement of said key information sensing elements with said key information elements and before said main rotor reaches said latched position, said lock information elements being formed with respective notches, said test element including a latch portion aligned with said notches when said engaged key information elements conform with said stored lock information, and said control means including yieldably resilient means biasing said latch portion into latching engagement with the aligned test notches, said bolt means responding to said latching engagement by moving into said ineffective position, said control means further including means for maintaining said latching engagement during relative rotation of said rotors and for thereby holding the lock information elements in respective fixed positions relative to said auxiliary rotor and disengaging the lock information elements from said key information sensing elements during said movement of said main rotor from said latched position toward said other terminal position, whereby the lock has not stored lock information in said other terminal position of said main rotor.

9. The lock of claim 1, wherein said test means include a test element and control means for moving the test element into sensing engagement with said lock information elements during rotation of said main rotor toward said latched position after engagement of the key information elements by said key information sensing elements and before said main rotor reaches said latched position, said lock information elements being formed with respective notches, and said test element including a latch portion aligned with said notches if the sensed key information elements conform with the stored lock information, said control means including spring means biasing said latch portion into latching engagement with the aligned notches, said bolt means responding to said latching engagement by moving into said ineffective position.

10. The lock of claim 1, wherein said test means include a first test element and a second test element and first and second control means respectively associated with said test elements for moving the associated test elements into sensing engagement with respective first and second groups of said lock information elements during rotation of said main rotor from said open lock position to said latched position after said key information sensing elements have engaged the associated key information elements, and before said main rotor has reached said latched position, said lock information elements being formed with respective test notches, said elements including each a latch portion aligned with the test notches of the lock information elements of the associated group, if the engaged key information elements associated with the respective groups conform with the stored lock information, said control means including spring means biasing each of said latch portions into latching engagement with the aligned test notches, said bolt means responding only to simultaneous latching engagement of said first and second test elements by moving into said ineffective position, said control means further including means for maintaining said first test element in said latching engagement during relative movement of said rotors, thereby to hold the lock information elements of said first group in a fixed position relative to said auxiliary rotor and for disengaging said lock information elements of said first group from the associated key information sensing elements to enable the disengaged key information sensing elements to be returned to said starting position whereby, in the open lock position, the lock does not contain stored lock information.

11. The lock of claim 1 further comprising a latch movably mounted on said auxiliary rotor, said key information sensing elements being formed with respective notches, and control means for moving said latch into latching enagement with said notches in response to movement of said main rotor from said open lock position toward and latched position after the key information sensing elements have engaged the key information elements and before the test means have engaged said positioned lock information elements, the latch including means for holding the key information sensing elements in a position of engagement with the engaged key information elements while said main rotor is in said latched position.

12. The lock of claim 1, wherein said coupling means include means releasing said lock information elements from the associated sensing element responsive to movement of said main rotor from the other terminal position toward said latched position and from said latched position to said one terminal position.

* * * * *